US006293834B1

(12) United States Patent
Huang

(10) Patent No.: US 6,293,834 B1
(45) Date of Patent: Sep. 25, 2001

(54) ELECTRICAL CONTACT HAVING SPRING ARMS WITH DISPLACEMENTS ORTHOGONAL TO EACH OTHER

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/558,247

(22) Filed: Apr. 25, 2000

(51) Int. Cl.[7] ..... H01R 13/22

(52) U.S. Cl. ..... 439/862

(58) Field of Search ..... 439/862

(56) References Cited

U.S. PATENT DOCUMENTS 5,387,116 * 2/1995 Wang ..... 439/862
5,595,513 * 1/1997 Kondo ..... 439/862
5,885,090 * 3/1999 Comstock et al. ..... 439/862

* cited by examiner

*Primary Examiner*—Gary F. Paumen
(74) *Attorney, Agent, or Firm*—Wei Te Chung

(57) ABSTRACT

An electrical contact comprises a body portion defining first and second ends which are opposite to each other. A first spring arm extends from the first end, and a second spring arm extends from the second end wherein a displacement of a second contacting end of the second spring arm is orthogonal to a displacement of a first contacting end of the first spring arm. The second spring arm has a larger Young's modulus than the first spring arm.

1 Claim, 4 Drawing Sheets

ELECTRICAL CONTACT HAVING SPRING ARMS WITH DISPLACEMENTS ORTHOGONAL TO EACH OTHER

FIELD OF THE INVENTION

The present invention relates to an electrical contact, and more particularly to an electrical contact having two spring arms for respectively and electrically connecting two elements. The displacements of the spring arms are orthogonal to each other.

DESCRIPTION OF THE PRIOR ART

There are a variety of electrical contacts for use with a variety of electrical connectors for different field applications. In general, an electrical contact includes a body portion, a spring arm, and a solder tail. The body portion is usually and securely embedded in a housing of the connector thereby attaching the electrical contact to the housing. The spring arm generally extends into a passageway for electrically connecting with a complementary contact of a mated connector. The solder tail is either soldered to a printed circuit board or a conductive wire of a cable. This electrical contact can be referred to as a single-beam contact. Some of the electrical contacts are formed with dual-beam in which a complimentary contact is sandwiched between the dual-beam type spring arms. Among the single-beam and the dual-beam contacts, both the spring arms, body portion and the solder tail are located in a same plane.

U.S. Pat. Nos. 4,770,180 and 5,102,353 disclose a dual-beam type contact and which extend from a body portion thereof. The spring arms extend upward and downward respectively to defining a space therebetween for receiving a complementary contact. Even the spring arms are offset from each other, the spring arms extend from the same side of the contact.

SUMMARY OF THE INVENTION

An objective of this invention is to provide an electrical contact having two spring arms for respectively and electrically connecting two elements which are located in two planes which are orthogonal to each other. The displacements of the spring arms are orthogonal to each other.

Another objective of this invention is to provide an electrical contact with two springs of different Young's modulus.

In order to achieve the objectives set forth, an electrical contact for bridging a first device to a second device which is movably positioned respect to the first device, comprises a body portion for securely mounting to a supporting frame. A first spring arm extends from an end of the body portion for selectively and electrically contacting the first device. The first spring arm forms a first contacting end. A second spring arm extends from the other end of the body portion for permanently and electrically contacting the second device. The second spring arm forms a second contacting end. When the second device is positioned at a first position, the first and second devices are electrically disconnected, and when the second device is positioned at a second position, the first and second devices are electrically connected.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Referring to FIGS. 1 to 4, an electrical contact 1 in accordance with the present invention generally comprises a body portion 10 defining first and second ends 10*a* and 10*b*. A first spring arm 11 extending from the first end 10*a*, and a second spring arm 12 extends from the second end 10*b*. The first spring arm 11 includes a first contact end 11*a*, while the second spring arm 12 includes a second contact end 12*a*.

According to a preferable embodiment of the present invention, the body portion 10 has an L-shaped body configuration defining long and short portions 10*c* and 10*d*. The first spring arm 11 extends from the first end 10*a* of the long portion 10*c*, while the second spring arm 12 extends from the second end 10*b* of the short portion 10*d*. The long portion 10*c* is further provided with two windows 10*e*.

Figure 1:
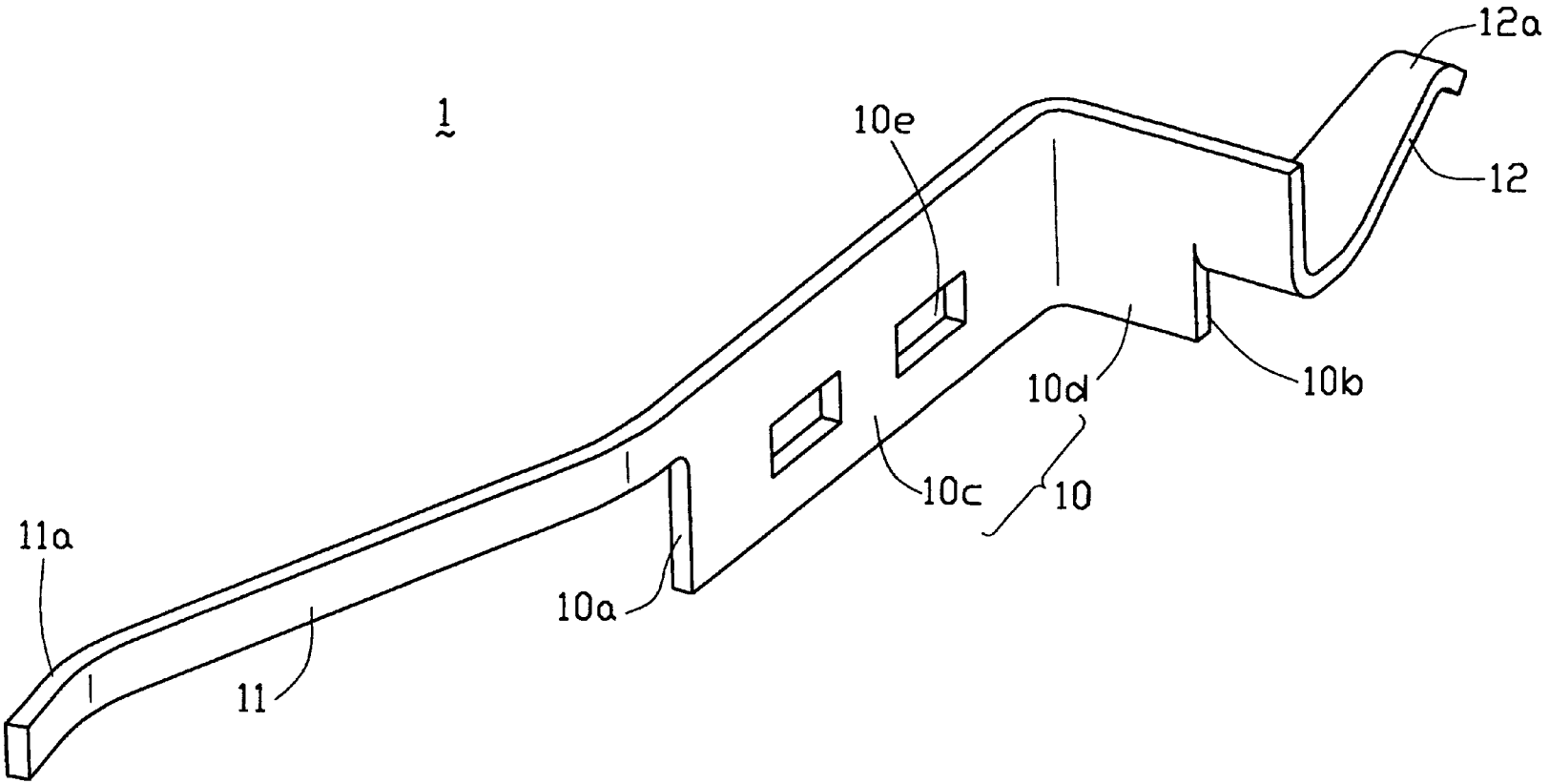
FIG. 1 is a perspective view of an electrical contact in accordance with the present invention.

As clearly shown in FIG. 1, the first spring arm 11 extends along a direction which can be viewed as parallel to a plane of the long portion 10*c*, while the second spring arm 12 extends perpendicularly to a plane of the short portion 10*d*. It can be easily appreciated that when the first contact end 11*a* is exerted with an external force, the displacement of the first contact end 11*a* is perpendicular to the plane of the long portion 10*c*, while the displacement of the second contact end 12*a* is parallel to the plane of the short portion 10*d*. Accordingly, the displacements of the first and second contact ends 11*a*, 12*a*, of the first and second spring arms 11, 12 are orthogonal to each other.

In addition, the first spring arm 11 is comparatively longer than the second spring arm 12. As a result, the first spring arm 11 is more resilient than the second spring arm 12. In fact, in order to provide a "rigid" resilience to the second spring arm 12, the second spring arm 12 is convergent toward its contact end 12*a*, while the first spring arm 12 has a unitary width lengthwise.

Figure 2:
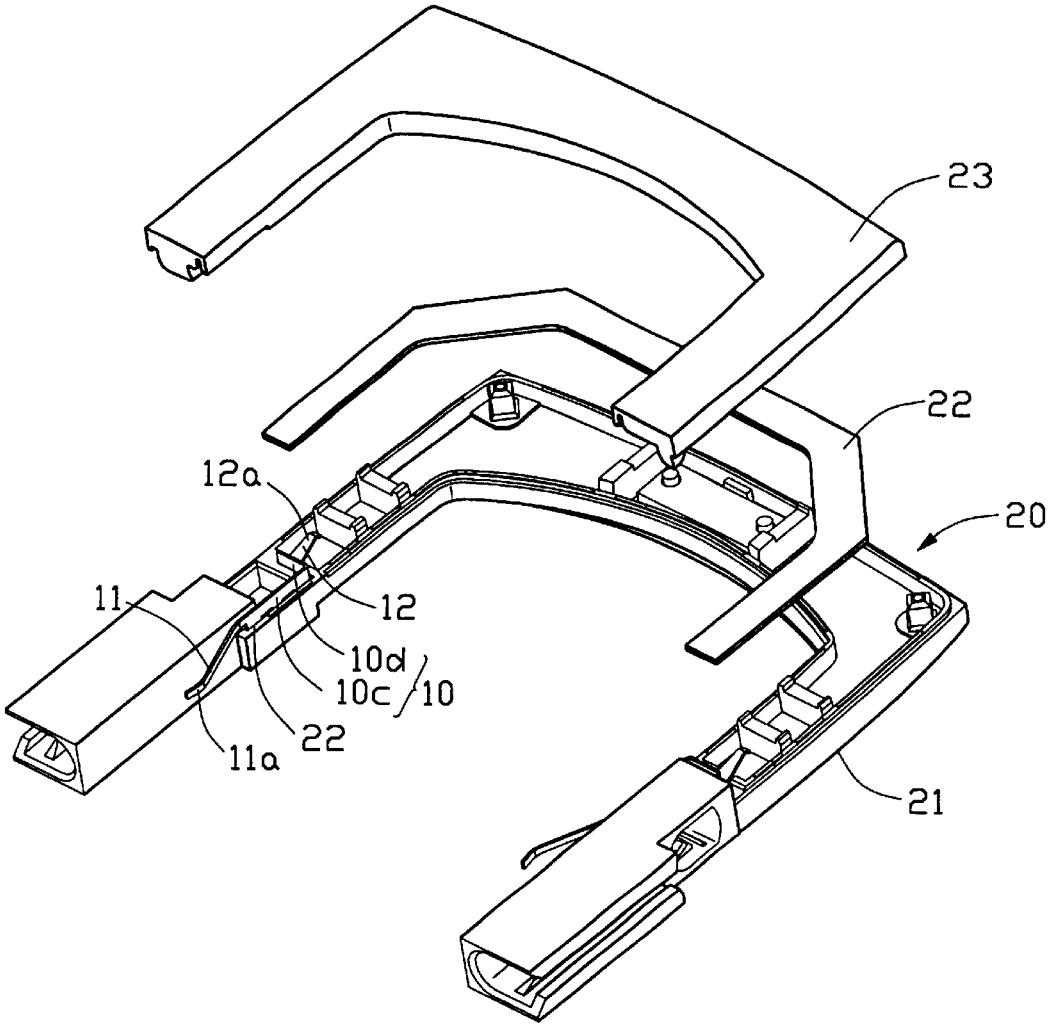
FIG. 2 is a perspective view of an electrical apparatus in which the electrical contact is used to bridge an antenna and a printed circuit board.
Figure 3:
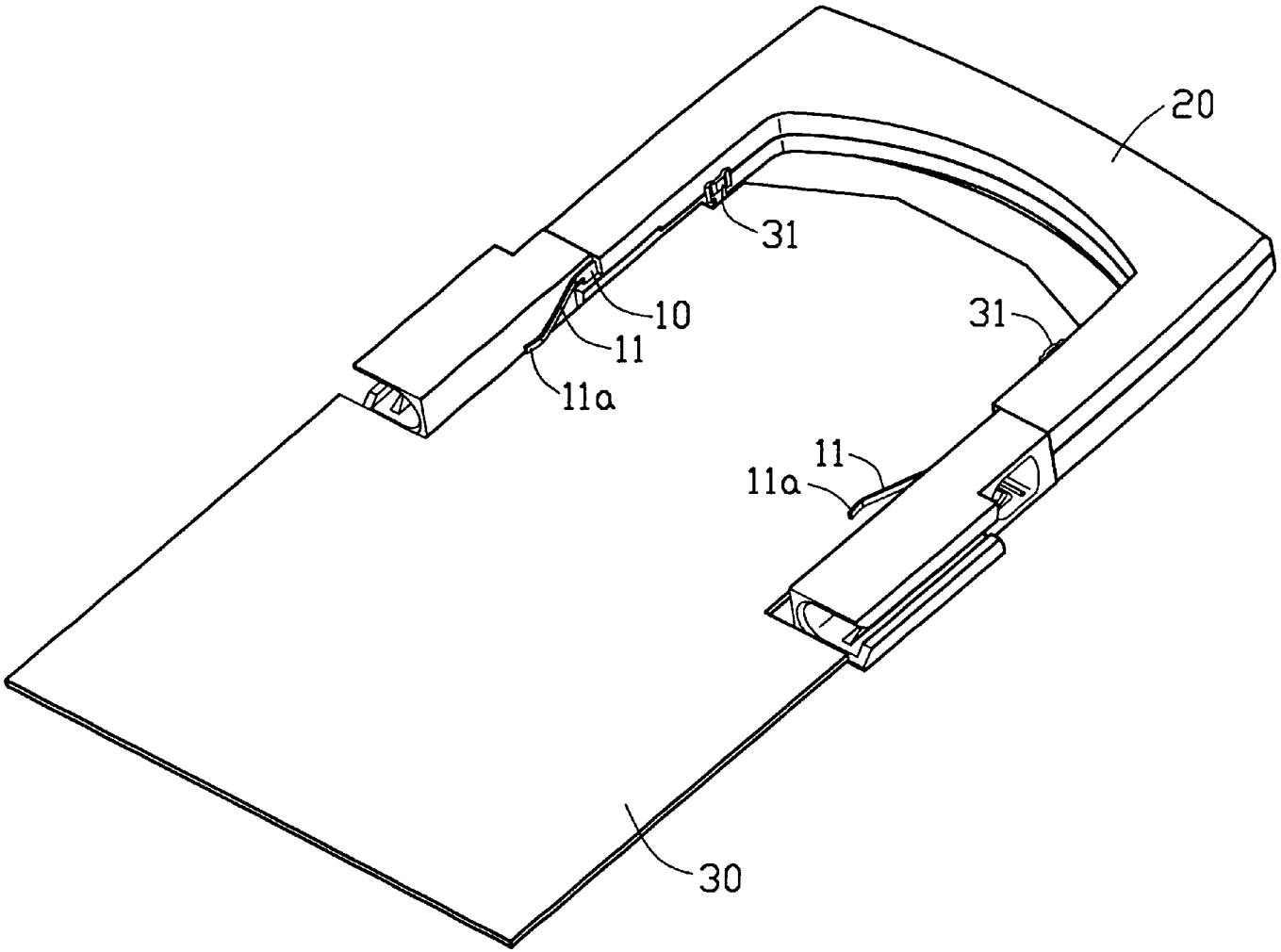
FIG. 3 is a perspective view in which a first spring arm is electrically disconnected from a contact of the printed circuit board.
Figure 4:
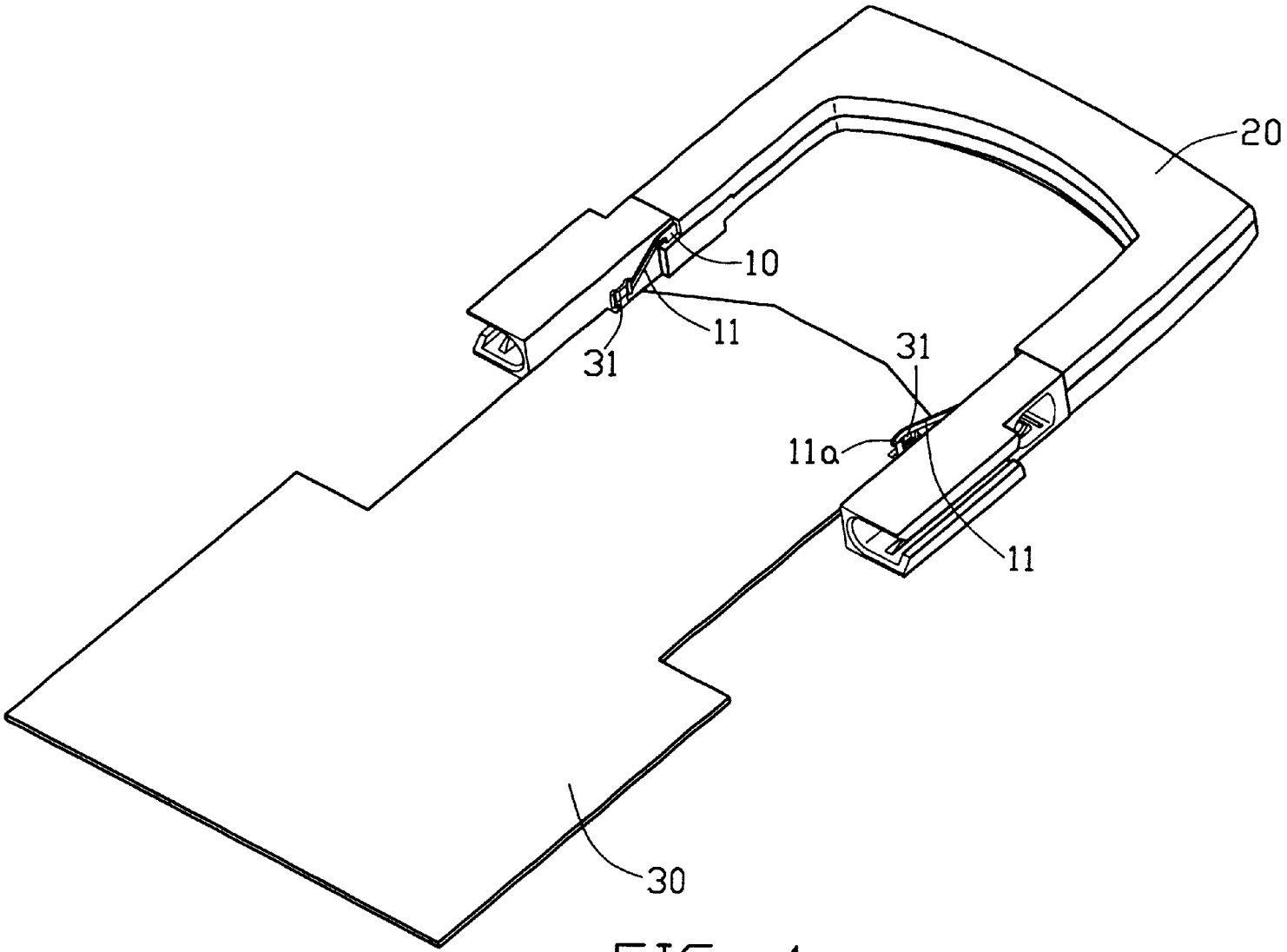
FIG. 4 is a perspective view in which the first spring arm is electrically connected to the contact of the printed circuit board.

Now referring to FIGS. 2 to 4, the electrical contact 1 is used to electrically and selectively bridge an antenna device 20 and a printed circuit board 30. The antenna device 20 includes a housing 21 on which a recess 22 is defined for securely receiving the electrical contact 1 therein. When the electrical contact 1 is securely seated, the first spring arm 11 extends away from the housing 21, while the second spring arm 12 is located within the housing 21. An antenna 22 is assembled in the housing 21 and which includes a pair of conductive pads (not shown) for electrically connecting with the second spring arm 12. The antenna device 20 further includes an upper cover 23 which encloses the antenna 22 to the housing 21. The printed circuit board 30 includes also a conductive post 31 which can be electrically contacted with the first spring arm 11.

In fact, the printed circuit board 30 is fixedly disposed in a card frame (not shown), while the antenna device 20 is slidably positioned to the card frame. Since the card frame is not the subject matter of the present invention, no detailed description is given.

Since the antenna device 20 is moveably arranged with respect to the printed circuit board 30. In the retracted position, the first spring arm 11 is electrically disconnected from the conductive post 31 of the printed circuit board 30. While when the antenna device 20 is positioned in a fully extended position, the first spring arm 11 is electrically connected with the conductive post 31. Since the first spring arm 11 is provided with soft resilience, extension of the antenna device 20 can be easily done.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical contact for bridging a first device to a second device which is movably positioned respect to said first device, comprising:

a body portion for securely mounting to a supporting frame;

a first spring arm extending from an end of said body portion for selectively and electrically contacting said first device, said first spring arm forming a first contacting end; and a second spring arm extending from the other end of said body portion for permanently and electrically contacting said second device, said second spring arm forming a second contacting end; wherein when said second device is positioned at a first position, said first and second devices are electrically disconnected, and when said second device is positioned at a second position, said first and second devices are electrically connected;

wherein said first spring arm is directed such that the displacement of said first contacting end is in a first direction;

wherein said second spring arm is directed such that the displacement of said second contacting end is in a second direction which is orthogonal to the first direction;

wherein the Young's modulus of the first spring arm is smaller than the Young's modulus of the second spring arm;

wherein said second spring arm is convergent toward said second contacting end;

wherein said body portion includes an L-shaped configuration having long and short sides, said first spring arm extending from said long side, while said second spring arm extends from said short side;

wherein said second spring arm extends forwardly and upwardly from a bottom edge of said short side of said body portion.

* * * * *